US010718162B2

(12) United States Patent
Van Duivendijk et al.

(10) Patent No.: US 10,718,162 B2
(45) Date of Patent: Jul. 21, 2020

(54) SERVICING A TOP DRIVE DEVICE OF A WELLBORE DRILLING INSTALLATION

(71) Applicant: ITREC B.V., Schiedam (NL)

(72) Inventors: Pieter Dirk Melis Van Duivendijk, Schiedam (NL); Diederick Bernardus Wijning, Schiedam (NL); Nicolaas Thijs Pieter Max, Schiedam (NL); Jasper Hendrik Frank Bakker, Schiedam (NL); Adriaan Van Swieten, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 4 days.

(21) Appl. No.: 15/767,447

(22) PCT Filed: Oct. 7, 2016

(86) PCT No.: PCT/NL2016/050696
§ 371 (c)(1),
(2) Date: Apr. 11, 2018

(87) PCT Pub. No.: WO2017/065603
PCT Pub. Date: Apr. 20, 2017

(65) Prior Publication Data

US 2018/0298694 A1 Oct. 18, 2018

(30) Foreign Application Priority Data

Oct. 12, 2015 (NL) ..... 2015604
Oct. 12, 2015 (NL) ..... 2015605
Jun. 15, 2016 (NL) ..... 2016971

(51) Int. Cl.
*E21B 19/06* (2006.01)
*E21B 19/20* (2006.01)
(Continued)

(52) U.S. Cl.
CPC ..... *E21B 3/02* (2013.01); *E21B 15/00* (2013.01); *E21B 15/04* (2013.01); *E21B 19/008* (2013.01);
(Continued)

(58) Field of Classification Search
CPC ..... E21B 19/161; E21B 19/20; E21B 3/02; E21B 15/00; E21B 19/06
See application file for complete search history.

(56) References Cited

U.S. PATENT DOCUMENTS 5,211,251 A 5/1993 Woolslayer
5,501,286 A * 3/1996 Berry ..... E21B 15/00 175/203
(Continued)

FOREIGN PATENT DOCUMENTS

WO WO 88/08069 A2 10/1988
WO WO 00/23686 A 4/2000
(Continued)

OTHER PUBLICATIONS

International Search Report (PCT/ISA/210) issued in PCT/NL2016/050696, dated Mar. 29, 2017.
(Continued)

*Primary Examiner* — Cathleen R Hutchins
(74) *Attorney, Agent, or Firm* — Birch, Stewart, Kolasch & Birch, LLP

(57) ABSTRACT

A method for servicing a top drive device of a wellbore drilling installation. The installation comprises a drilling tower, a drill floor having a well center through which a drilling tubulars string can pass along a firing line. A trolley is guided along a vertical trolley rail. A top drive device is attached to the trolley and comprises one or more top drive. A motion arm assembly comprises a base and an extensible and retractable motion arm, wherein the base is guided by a
(Continued)

vertical motion arm rail. The motion arm has an operative reach that encompasses the firing line. The motion arm assembly is adapted to support at least one of a well center tool, e.g. an iron roughneck tool and a tubular gripper member, and allowing to bring said well center tool or tubular gripper member in the firing line. In order to remove a top drive motor from the top drive device whilst the rest of the top drive device remains attached to the trolley, the motion arm assembly and/or the trolley are operated so that the top drive motor is within the operative reach of the motion arm, the motion arm is operated to reach the top drive motor and the top drive motor is connected to the motion arm, and then the motion arm is used to support and/or lift, lower said top drive motor upon disconnection thereof from the rest of the top drive device.

20 Claims, 8 Drawing Sheets

(51) Int. Cl.

| | |
|---|---|
| ***E21B 3/02*** | (2006.01) |
| ***E21B 15/00*** | (2006.01) |
| ***E21B 19/14*** | (2006.01) |
| ***E21B 15/04*** | (2006.01) |
| ***E21B 19/16*** | (2006.01) |
| ***E21B 19/00*** | (2006.01) |
| ***E21B 19/08*** | (2006.01) |
| ***E21B 19/15*** | (2006.01) |
| *E21B 17/03* | (2006.01) |

(52) U.S. Cl.
CPC ..... *E21B 19/06* (2013.01); *E21B 19/08* (2013.01); *E21B 19/14* (2013.01); *E21B 19/146* (2013.01); *E21B 19/155* (2013.01); *E21B 19/16* (2013.01); *E21B 17/03* (2013.01)

(56) References Cited

U.S. PATENT DOCUMENTS

| | | | | |
|---|---|---|---|---|
| 6,056,071 | A | 5/2000 | Scott et al. | |
| 2009/0084537 | A1* | 4/2009 | Rudshaug | E21B 3/02 166/77.51 |
| 2013/0090200 | A1 | 4/2013 | Richardson | |
| 2016/0090786 | A1* | 3/2016 | Roodenburg | E21B 3/02 175/57 |
| 2017/0044875 | A1* | 2/2017 | Hebebrand | E21B 47/122 |
| 2018/0216405 | A1* | 8/2018 | De Mul | E21B 3/02 |

FOREIGN PATENT DOCUMENTS

| | | | |
|---|---|---|---|
| WO | WO 2007/076403 | A2 | 7/2007 |
| WO | WO 2013/077905 | A2 | 5/2013 |
| WO | WO 2014/182160 | A2 | 11/2014 |
| WO | WO 2015/133895 | A1 | 9/2015 |

OTHER PUBLICATIONS

Written Opinion of the International Searching Authority (PCT/ISA/237) issued in PCT/NL2016/050696, dated Mar. 29, 2017.

* cited by examiner

SERVICING A TOP DRIVE DEVICE OF A WELLBORE DRILLING INSTALLATION

FIELD OF THE INVENTION

The present invention relates to the servicing a top drive device of a wellbore drilling installation, e.g. mounted on an offshore drilling vessel.

BACKGROUND OF THE INVENTION

In WO2014/182160 an offshore vessel with a wellbore drilling installation is disclosed which comprises:

- drilling tower,
- a drill floor having a well center through which a drilling tubulars string can pass along a firing line,
- at least one vertical trolley rail supported by the drilling tower,
- a trolley, said trolley being guided along said at least one vertical trolley rail,
- a top drive device attached to the trolley, said top drive device comprising one or more top drive motors, e.g. electric top drive motors, adapted to impart rotary motion to a drilling tubulars string when connected to said top drive device,
- a hoisting device adapted to move the trolley with the top drive device up and down along said at least one vertical trolley rails,
- a vertical motion arm rail supported by the drilling tower,
- a motion arm assembly comprising a base and an extensible and retractable motion arm, wherein the base is guided said at least one vertical motion arm rail, and wherein the motion arm has an operative reach that encompasses the firing line, said motion arm assembly being adapted to support at least one of a well center tool, e.g. an iron roughneck tool, or a tubular gripper member, and allowing to bring said well center tool or tubular gripper member in the firing line,
- a vertical motion arm drive adapted to move the motion arm base along said vertical motion arm rail.

In the field, especially in the offshore drilling field, downtime due to equipment failure is considered a major issue. Whilst a drilling or other wellbore related operation involves the use of numerous pieces of equipment, studies seem to indicate that the top drive device is one of the major contributors to undesirable downtime.

The company LeTourneau Technologies Drilling Systems Inc. identified the gearbox as crucial component in this regard and has developed a hollow shaft electric drive motor that acts as a direct drive for the rotary output stem or quill that is driven by the motor. This eliminates the gearbox yet requires a special design of the motor.

In US20130090200 the issue of top drive reliability is also addressed and an alternative structure of the transmission between the electric motors and the rotary quill is disclosed.

Other developments in the field concentrate on enhanced maintenance schedules for equipment, including of the top drive, to prevent failures from occurring.

Notwithstanding the efforts made so far to reduce downtime, failures of top drive devices still occur at the expense of very costly downtime of the drilling installation.

OBJECT OF THE INVENTION

A first aspect of the present invention aims to propose measures that allow to reduce the downtime due to top drive failure and/or allow to enhance serviceability of the top drive during regular maintenance.

SUMMARY OF THE INVENTION

The first aspect of the invention proposes a method, which is characterised in that in order to remove a top drive motor from the top drive device whilst the rest of the top drive device remains attached to the trolley, the motion arm assembly and/or the trolley are operated so that the top drive motor is within the operative reach of the motion arm, the motion arm is extended to reach the top drive motor and the top drive motor is connected to the motion arm, and then the motion arm is used to support and/or lift said top drive motor upon disconnection thereof from the rest of the top drive device.

The inventive method of the first aspect of the invention is based on the insight that by facilitating the removal of a top drive motor by means of the motion arm whilst the rest of the top drive device remains attached to the trolley the time and effort needed for any servicing can be greatly reduced.

In particular nowadays heavy duty top drives are used which include one or more electric motors, e.g. two motors, with more than 300 kW power rating each. For example the TDS-11SA AC top drive of NOV has two AC motors of 400 kW each. These motors are fitted on top of a transmission housing, with the rotary stem or quill projecting below said transmission housing. The transmission housing is connected to a bail that allows to suspend the top drive from a hook of a winch and cable type hoisting device. At the rear of the top drive a sliding trolley is fitted, that slides along a single vertical guide rail.

The first aspect of the invention proposes that in case of failure of a motor of the top drive and/or in case of the need to remove a motor from the top drive device to gain access to another part of the top drive device, e.g. the gearbox, the thrust bearing, etc., the motion arm assembly is used as a handler for the motor to be removed.

It will be appreciated that the same motion arm assembly may also be used when desiring to replace a motor in the top drive device attached to the trolley, e.g. when a spare top drive motor is used to replace to faulty motor.

The connection between the respective top drive motor and the motion arm may be established by using a rope sling, a chain, steel wire, or other flexible element. For example the end of the motion arm is provided with a hook from which the motor is then suspended.

Instead of simply suspending the respective top drive motor from the motion arm it is preferred to establish a direct mechanical coupling and fixation between the motion arm and the respective top drive motor, so that the motion arm fully and directly controls the motion of the coupled top drive motor. For example in the offshore field this approach allows to avoid any problems with swaying as the vessel may be subjected to sea-state induced motions. In this perspective it is proposed that the top drive motor is fitted, e.g. permanently or only temporarily during servicing, with a coupler part that is to be mated with a corresponding coupler part fitted on the motion arm such that the motor becomes mechanically integrated with the motion arm and fully and directly follows any motion of the motion arm.

In an embodiment the coupler part is integrated with the stator housing of the motor, yet in another embodiment the motor is mounted in a subframe, with the subframe being provided with the mechanical coupler part. This will allow easier implementation of the invention as no or minor changes of the motor will be required compared to presently used top drive motors.

Most preferably the one or more well center tools, e.g. iron roughneck, and/or tubular gripper member which is/are to be handled by the same motion arm is/are provided with a similar coupler part as the motor or motors of the top drive device.

For example in a vertical axis electric top drive motor it is envisaged that a mechanical coupler part is arranged, temporarily or permanently, on a lateral side of the motor housing, such that the motion arm can couple thereto with a mating mechanical coupler part. Arranged such a mechanical coupler part on the side of the vertical motor housing may be advantageous as it does not require head space above the motor, which would e.g. be needed if the motor was to be suspended below the end of the motion arm. The lateral arrangement of the coupler part on the vertical motor housing is also advantageous in a embodiment of the top drive device wherein one or more top drive motors, each with vertical axis, are mounted underneath a gearbox or transmission housing with the rotary stem or quill extending downwards from said housing, e.g. in a space between two top drive motors.

The first aspect of the invention envisages an embodiment wherein use is made of a top drive device with one or more motors, e.g. electric motors, that are equipped with a motion arm coupler part that mates with a coupler part of the motion arm, for example similar to the coupler parts that are used to couple an excavator bucket to the arm of an excavator. For example the coupler part on the motor comprises two parallel pins above one another and the coupler part on the motion arm has a hook portion engaging on one pin, e.g. the upper pin, and a hook portion engaging onto the other pin, e.g. the second or lower pin.

In an embodiment the top drive device and/or the trolley is provided with one or more platforms, e.g. with a railing, near the one or more top drive motors allowing for access of personnel to the top drive motors whilst the top drive device is attached to the trolley. For example a remote control of the motion arm used for handling the top drive motor is provided, which remote control is operated by an operator person standing on a platform near the respective motor.

For example the one or more electric top drive motors are vertically arranged in the top drive device that is attached to the trolley, that is with their axis vertically, with the coupler part of each motor comprising two pins in horizontal orientation for engagement with a mating coupler part of the motion arm, e.g. like an excavator bucket quick connection.

The motion arm may be a dedicated well center tool supporting motion arm, which includes a motion arm adapted to support the weight of the well center tool. For example this motion arm assembly is primarily used to support an iron roughneck tool above the well center in extended position of the motion arm. It is then envisaged that, in case a top drive motor has to be removed, the trolley is lowered so that the top drive motor is with reach of the motion arm. Then same arm, with the iron roughneck tool detached from the motion arm, is used to couple to the drive motor and to support and/or lift said motor in the course of its removal from the top drive device.

In an embodiment said at least one vertical motion arm rail is configured so that said motion arm, that is used in the inventive method for handling a top drive motor, can at other moments be operated in conjunction with a tubular gripper member, e.g. as disclosed in WO2014/182160, such that the motion arm assembly acts as a tubular racker assembly of a tubular racking device. Herein the tubular racking device may comprise multiple of such motion arm assembly at various heights, e.g. on a common vertical motion arm rail, to handle multi-joint tubulars, e.g. "triples" or "quads". The tubular racking device is then adapted to grip and retain a drilling tubular by the tubular racker assemblies, wherein the weight of the tubular is distributed over the motion arms of the tubular racker assemblies, and wherein the tubular racking device is adapted to place a tubular in and remove a tubular from the drilling tubulars storage rack.

The motion arms each have an operative reach at least allowing to transfer a tubular gripped by said first and second tubular racker assemblies between the drilling tubulars storage rack and a position of the tubular aligned with the firing line above the well center so as to allow for building and disassembly of a tubulars string, e.g. a drill string or a casing string.

In an embodiment with multiple motion arm assemblies on vertical rail along one side of the path of travel of the trolley and top drive device it may be possible that one motion arm assembly is used to handle a spare motor whilst another motion arm is used to handle the faulty motor. This may further reduce the time needed to replace a faulty motor by a spare motor.

For example a spare top drive motor is stored in a dedicated compartment within the operative reach of a motion arm assembly, e.g. said compartment being provided with electrical connections allowing the testing of the spare top drive motor. For example the spare top drive motor compartment is adjacent the drill floor. As is preferred the spare motor is provided with a mechanical coupler part, e.g. like an excavator bucket, allowing direct mechanical connection to the respective motion arm so that the motion arm is used to move the spare motor out of the compartment and then bring it to the top drive device.

In embodiment it is envisaged that on either lateral side of the vertical path of travel of the top drive device there is a vertical motion arm rail, e.g. identifiable as a left-hand and right-hand motion arm rail. On each of said rails at least one, preferably two or three, motion arm assembly is arranged that is vertically mobile along the respective rails. Preferably at least motion arm on each rail, preferably all motion arms on each rail, have an operative reach that encompasses the firing line. In an embodiment tubular storage racks are placed respectively left and right of the path of travel of the top drive device, with motion arms on either side being equipped, preferably releasably, with a tubular gripper member allowing the motion arms to act in unison as a tubular racker device between the respective storage and the firing line.

In particular in combination with a top drive device having top drive motors on either lateral side thereof, an embodiment is envisaged with at least one motion arm assembly on the left-hand side of the path of travel of the trolley and top drive device and one motion arm assembly on the right hand-side so that the left-hand motion arm can handle the one or more left-hand side motors and the right-hand motion arm can handle the one or more right-hand side motors.

When detaching a motor from the top drive device whilst the rest of the top drive device remains attached to the trolley according to the inventive approach, it may be desirable to use a second motion arm assembly, e.g. a motion arm assembly on the other side, to stabilize the top drive and/or trolley. For example when the heavy motor is removed the change in mass distribution might cause undue loading of some components, which then can be countered by using the second motion arm. For example the motion arm of an assembly on the other side is mechanically coupled to the top drive motor on the other side for stabilization purposes. In an alternative approach stabilization can be achieved by a motion arm holding the gearbox or transmission housing.

It will be appreciated that the inventive method of the first aspect of the invention is most effective if the one or more motors of the top drive device are easily accessible by the motion arm. For example the trolley has or is integrated with a frame that allows for lateral access of the motion arm to one or more motors of the top drive device.

For example the one or motors of the top drive are arranged with their axis vertically, e.g. with a lateral side of the motor housing being equipped with a coupler part that is to be mated with a coupler part on the motion arm.

In a preferred embodiment a top drive device is used where the one or more top drive motors are mounted at opposed lateral sides of the top drive device, e.g. one or two motors at each lateral side of the top drive device.

For example a top drive device is used with a transmission or gearbox housing to which said one or more motors with their axis vertically are secured by means of a bolts, e.g. through a mounting flange at one end of the motor.

In an embodiment with top drive motors at opposed lateral sides of the top drive device, e.g. one or two motors at each lateral side of the top drive device, it is envisaged that two distinct motion arm devices are provided in the drilling installation, the one or first motion arm device having an operative reach allowing to couple to the one or more top drive motors at the left-hand side and the other or second motion arm having an operative reach allowing to couple to the one or more top drive motors at the right-hand side.

In an embodiment two or more motion arm assemblies are mounted on a common set of one or more vertical motion arm rails supported by the drilling tower, with said motion arm rails extending over such a height that a multi-joint tubular stored in the storage rack can be gripped by the gripper members of two of the motion arm assemblies acting in unison as part of a tubular racker device.

In an embodiment the installation comprises at least one tubulars storage rack that is adapted to store multi-joint tubulars, e.g. triples or quads, therein in vertical orientation. Herein multiple motion arm assemblies are arranged on a vertical motion arm rail along a side of a vertical path of travel of the trolley with the top drive device along said at least one vertical trolley rail, at least two of said motion arms being adapted to be provided with a tubular gripper member, with said motion arm rail extending over such a height that a multi-joint tubular stored in the storage rack can be gripped by the gripper members of the motion arm assemblies which can act in unison as part of a tubular racker device.

For example three motion arm assemblies are mounted on said common set of one or more vertical rails, preferably with each of said motion arm assemblies having a configuration to handle a top drive motor during its removal from the top drive device attached to the trolley. It is however deemed favorable to lower the trolley to a height close above the drill floor when performing the removal of a top drive motor, allowing e.g. for easy access of personnel to the top drive device.

In general, if multiple motion arm assemblies are present above one another on a common set of one or more vertical rails, it is considered advantageous if the lowermost motion arm assembly is used for the handling of the top drive motor as this will easily allow the lowering of the top drive motor, e.g. onto the drill floor level.

It will be appreciated that in an embodiment with a vertical motion arm rail extending over significant height, e.g. as shown in WO2014/182160, the method of removal of a top drive motor may even be performed whilst a tubular sticks up above the drill floor. For example, e.g. in offshore drilling, the need may exist to stick up the drill string over e.g. 4 meters above the drill floor, to ensure that the bottom hole assembly does not contact the bottom of the drilled borehole or jams therein. Then the trolley with top drive device cannot be lowered to close on the drill floor. Yet the motion arm will still be able to reach the top drive motor and be of use in the removal of the top drive motor. With sufficient height of the one or more vertical motion arm rails the same process can be performed at any height of the trolley along its vertical motion range relative to the drilling tower.

As disclosed in WO2014/182160 it is preferred, in case multiple motion arm assemblies are provided, that these motion arm assemblies are structurally identical or at least contain identical main components, like the motion arms themselves.

In an embodiment the trolley is provided with a rigid frame that supports the top drive device, wherein the frame has a top frame member that is suspended from one or more winch driven cables of the hoisting device. For example the top frame member carries multiple sheaves in a side-by-side arrangement, with the sheaves having a common, horizontal, axis of rotation.

In an embodiment the frame comprises a lower frame member, spaced below the top frame member, that is rigidly connected via a front frame member and a rear frame member to the top frame member.

In an embodiment, as preferred, the lower frame member extends perpendicular to the axis of rotation of the multiple sheaves on the top frame member. This embodiment is e.g. advantageous in combination with a top drive device wherein two vertical axis electrical top drive motors are arranged underneath a gearbox or transmission housing, e.g. a left-hand motor and a right-hand motor, wherein said motors are in vertical projection on opposed sides of the lower frame member. The removal of these motors in the manner described herein is facilitated as the motors can, once detached from the housing, easily be lowered relative to the gearbox or transmission housing. It will be appreciated that said lowering can be performed by raising the trolley and/or lowering the respective motion arm assembly.

In an embodiment the lower frame member, e.g. embodied with two parallel lower frame girders, support a rotatable head clamp assembly that is provided with an open-centered body with a vertical passage there through that allows to lower the head clamp assembly from above over the top end of a tubular in the firing line, e.g. positioned in the firing line by a racker device during drilling operations or the top end of the tubular string suspended from a drill floor mounted slip device. The rotatable head clamp assembly is provided with a tool joint retainer assembly that is embodied to axially retain the tool joint or box member at the top of the tubular whilst the tool joint or box remains accessible for the quill or rotary stem of the top drive device.

As is preferred the rotatable head clamp assembly is provided with a thrust bearing adapted to support the load of the drilling tubular string during a drilling process, when the quill or rotary stem of top drive device is connected to the tool joint or box member of the top end of the drilling string, e.g. by a threaded connection, e.g. using a saver sub. This arrangement allows to dispense with the thrust bearing in the top drive device itself, and mount said thrust bearing in or on the lower frame member of the frame. The rotatable head clamp assembly can thus rotatably support an entire tubular string and allow for rotary motion thereof which is imparted by the rotary stem or quill of the top drive device.

The provision of the rotatable head clamp assembly with thrust bearing allows for reduced complexity of the top drive device compared to existing devices wherein the thrust bearing is very difficult to access and exchange.

The invention envisages an embodiment wherein the rotatable head clamp assembly including the thrust bearing preferably is embodied as an exchangeable unit, e.g. with a housing wherein the thrust bearing and the open-centered body of the assembly are mounted and wherein said housing is placed in a receptor of the lower frame member. For example the receptor is an open topped cavity in the lower frame member.

The top drive device can be mounted within the frame so as to be vertically mobile relative to the frame by one or more vertical displacement actuators, e.g. adapted to perform controlled lowering and raising of the top drive device during make up or breaking of the threaded connection between the quill or rotary stem on the one hand and the tool joint or box member of the tubular suspended from the rotatable head clamp on the other hand.

In an embodiment a flexible first drilling fluid hose is connected at one end to a rigid pipe piece fitted on the trolley, and a further flexible second drilling fluid hose is connected between said rigid pipe piece and the vertically mobile top drive device, e.g. to the fluid swivel thereof. It will be appreciated that the latter fluid hose can be rather short. The same arrangement can be provided for any hydraulic and/or electric lines that are to be connected to the top drive device. In this manner the vertically mobile top drive device is not subjected to the weight of the long first drilling fluid hose and other lines, which weight may be substantial if the drilling installation is e.g. embodied to handle triples or quads.

In an embodiment it is envisaged that the top drive device comprises a gearbox or transmission housing and two or more vertical axis electric motors mounted to said housing, e.g. one motor at each lateral side of the top drive device. For example the one or more vertical axis electric motors are arranged underneath the gearbox or transmission housing, e.g. each on a lateral side of the top drive device, with the rotary stem or quill extending downward from the gearbox or transmission housing in a space between said downward depending top drive motors. This arrangement may allow for a reduction of the height of the top drive device and/or related frame.

In an embodiment the frame comprises an elongated top frame member supporting multiple cable sheaves so that their sheaves revolve about a common horizontal axis intersecting the firing line, and a single vertical rear frame member depending from said top frame member. The trolley is then connected, e.g. permanently as a welded structure, to said rear frame member. The frame also comprises a single vertical front frame member, with a single lower frame member connected to the lower ends of said front and rear vertical frame members. The top drive device may then be guided by two vertical rails along the front and rear vertical frame members, so as to be vertically mobile relative to the frame, and, if present, relative to the rotatable head clamp assembly supported by the lower frame member.

In an embodiment it is envisaged that a motion arm assembly is employed to couple with a removable rotatable head clamp assembly, e.g. one or more rope slings being fitted between the motion arm assembly and the rotatable head clamp assembly. In another embodiment it is envisaged that a mechanical coupler part is temporarily secured to the removable head clamp assembly allowing for direct mechanical connection to a mating coupler part on the motion arm.

Preferably the top drive device can be raised relative to the rotatable head clamp assembly over such a height that the head clamp assembly can be lifted out of an open topped receptor cavity in or on the lower frame member.

The first aspect of the present invention further relates to a wellbore drilling installation with a top drive device according to claim 9.

The first aspect of the present invention further relates to the combination of:

- a top drive device with a top drive motor provided with a mechanical coupler part,
- a motion arm assembly comprising a base and an extensible and retractable motion arm, wherein the base is adapted to be guided by at least one vertical motion arm rail, and wherein the motion arm is provided with a mechanical coupler part that is to be mated with the coupler part on the top drive motor such that the motor becomes mechanically integrated with the motion arm and fully and directly follows any motion of the motion arm.

A second aspect of the invention relates to a combination of a wellbore drilling trolley and top drive device.

As explained with reference to the first aspect of the invention, serviceability of such a trolley and top drive combination can be enhanced by providing a rotatable head clamp assembly with a thrust bearing that absorbs the vertical load of the drill string in the firing line, wherein the rotatable head clamp assembly is supported by the frame below the top drive device. This arrangement allows to dispense with this thrust bearing in the top drive device itself, e.g. allowing for a light thrust bearing in the top drive device or the entire absence of a thrust bearing in the top drive device. If present in the top drive device, any thrust bearing will be significantly less loaded during operational use and thereby less prone to wear compared to existing designs. Also, as explained herein, the thrust bearing in the rotatable head clamp assembly can be accessed easier compared to such a bearing located in the gearbox or transmission housing of the top drive device. In an embodiment the rotatable head clamp assembly is readily exchangeable as a unit, allowing decoupling of the unit from the frame or the rest of the frame, e.g. for replacement by a spare rotatable head clamp assembly unit.

The second aspect of the invention provides a combination which comprises:

- a trolley adapted to be guided along or guided along at least one vertical trolley rail,
- a top drive device attached to the trolley, the top drive device comprising:
  - one or more top drive motors, e.g. electric top drive motors,
  - a gearbox or transmission housing,
  - a rotary stem or quill driven by the one or more top drive motors, wherein the top drive device being adapted to impart rotary motion to a drilling tubulars string when connected to the rotary stem or quill of the top drive device, wherein, preferably, the trolley comprises a frame with a top frame member that is adapted to be suspended from one or more winch driven cables of a hoisting device, wherein the frame supports, below the top drive device, a rotatable head clamp assembly that is provided with an open-centered rotary body with a vertical passage there through that allows to lower the rotatable head clamp assembly from above over a top end of a tubular in the firing line, wherein the rotatable head clamp assembly is provided with a retainer assembly, e.g. a tool joint retainer assembly, that is embodied to axially retain the top end, e.g. the tool joint or box member at the top end, of the tubular whilst the top end, e.g. the tool joint or box member, remains accessible for the rotary stem or quill of the top drive device, e.g. said tool joint or box member having a shoulder and said rotatable head clamp assembly having one or more mobile retainers that are engageable with said shoulder, e.g. underneath said shoulder, wherein the rotatable head clamp assembly is provided with a thrust bearing that is adapted to support the load of a drilling tubular string during a drilling process, when the quill or rotary stem of top drive device is connected to the top end, e.g. the tool joint or box member of the top end, of the drilling string, e.g. by a threaded connection, e.g. using a saver sub.

In an embodiment it is envisaged that a special sub, so a relatively short tubular, is connected to top end of a drilling tubular, e.g. a drill pipe, wherein the special sub is adapted to cooperate with the retainer assembly and with the rotary stem or quill of the top drive. In an embodiment the sub has at its upper end a tool joint or box member similar or identical to such a tool joint or box member at the end of a drilling tubular, e.g. drill pipe. E.g. the sub has a threaded portion adapted to be screwed together with a threaded portion of the rotary stem or quill of the top drive device. In another embodiment the sub and rotary stem or quill lack cooperating threaded portions and have other torque transmitting cooperating portions, e.g. the sub having a non-cylindrical portion and the rotary stem or quill having a mating portion, e.g. like a hex key, e.g. like a hex key with a ball end.

In an embodiment the trolley comprises a loop shaped frame with:

- a top frame member that is adapted to be suspended from one or more winch driven cables of the hoisting device,
- a lower frame member, spaced below the top frame member,
- a first frame member and a second frame member connecting the lower frame member to the top frame member, for example said first and second frame members being a front and rear frame member respectively or, for example, said first and second frame members being a left-hand and right-hand frame member respectively, wherein the top drive device is arranged generally within the opening in the loop shaped frame, and wherein the lower frame member supports a rotatable head clamp assembly.

In an embodiment the rotatable head clamp assembly including the thrust bearing is embodied as an exchangeable unit. For example the unit has a housing wherein the thrust bearing and the open-centered body of the assembly are mounted and said housing is placed in a receptor of the lower frame member of the frame of the trolley. For example the receptor is an open topped cavity in the lower frame member. In another embodiment the lower frame member is integrated as an exchangeable unit with the rotatable head clamp assembly including the thrust bearing, so the lower frame member becomes a carrier integrated with the head clamp assembly.

In an embodiment the top drive device is mounted within the frame of the trolley so as to be vertically mobile relative to the frame by one or more vertical displacement actuators, e.g. adapted to perform controlled lowering and raising of the top drive device during make up or breaking of a threaded connection between the quill or rotary stem on the one hand and the tool joint or box member of the tubular, e.g. the sub fitted at the top of a regular drill pipe, suspended from the rotatable head clamp assembly on the other hand.

In an embodiment one or more vertical actuators are provided that allow to vertically displace at least the rotary stem or quill relative to the rotatable head clamp assembly. This design is based on the insight that it may for example be advantageous to apply a telescopic rotary stem or quill, e.g. a splined rotary stem, e.g. similar to a floating quill, and allow the rest of the top drive to be stationary mounted in the frame of the trolley.

In an embodiment the combination comprises one or more vertical actuators adapted to perform controlled relative lowering and raising of the rotary stem or quill during make up or breaking of a threaded connection between the quill or rotary stem on the one hand and the tool joint or box member of a tubular suspended from the rotatable head clamp assembly on the other hand.

In an embodiment wherein the top drive device is vertically mobile relative to the frame of the trolley, it may be advantageous to provide for an arrangement wherein a flexible first drilling fluid hose is suspended from an elevated position and hangs in an open loop, which hose is connected at an end thereof to a rigid pipe piece that is fitted on the trolley, and wherein a shorter, flexible second drilling fluid hose is connected between this rigid pipe piece and the vertically mobile top drive device, e.g. to a fluid swivel thereof.

In an embodiment the retainer assembly comprises pivotal levers that are pivotal about a horizontal fulcrum on the rotary body and that are adapted to engage with an inner end thereof below a shoulder on the top end of the tubular that has been inserted through the open center in the rotary body. Other designs, e.g. with horizontally slidable retainer members, e.g. like sliding dogs in a riser spider, are also envisaged.

The second aspect of the invention also relates to an exchangeable unit with rotatable head clamp assembly as described herein, which unit is adapted to be releasably connected to a frame of a wellbore drilling trolley.

The second aspect of the invention also relates to a method for drilling a wellbore wherein use is made of a trolley and top drive device combination as described herein.

The second aspect of the invention also relates to a method for drilling a wellbore wherein use is made of a trolley and top drive device combination as described herein, wherein a drill string is suspended from the rotatable head clamp assembly as the top end of the drill string is axially retained by the retainer assembly thereof, and wherein rotary motion is imparted to the drill string by means of the top drive device, whereof the rotary stem or quill is connected to the top end of the drill string. Herein the vertical load of the drill string is, at least in majority, absorbed by the thrust bearing of the rotatable head clamp assembly and transmitted via the frame of the trolley to a hoisting device of the drilling installation.

The second aspect of the invention also relates to a method for servicing a trolley and top drive device combination as described herein, wherein the rotatable head clamp assembly is embodied as an exchangeable unit and wherein, in case of a service routine, the unit is exchanged for another exchangeable unit with rotatable head clamp assembly.

A third aspect of the invention relates to a combination of a wellbore drilling trolley and top drive device, which combination comprises:

- a trolley, said trolley being adapted to be guided along at least one vertical trolley rail,
- a top drive device attached to the trolley, said top drive device comprising one or more top drive motors, e.g. electric top drive motors, adapted to impart rotary motion to a drilling tubulars string when connected to said top drive device, wherein the trolley comprises a loop shaped frame with:

- a top frame member that is adapted to be suspended from one or more winch driven cables of the hoisting device, e.g. cable sheaves connecting directly, selectively releasable and/or permanently secured, to said top frame member or e.g. the top frame member being engageable by a hook of a travelling sheaves block,
- a lower frame member, spaced below the top frame member,
- a first frame member and a second frame member connecting the lower frame member to the top frame member, wherein said first and second frame member are either front and rear frame members respectively, or are left-hand and right-hand frame members respectively, wherein, possibly, said top frame member, lower frame member, and first and second frame members form a rigid loop shaped frame, or wherein, possibly, said lower frame member is releasably connected to said first and second frame members, wherein, possibly, the lower frame member extends perpendicular to the top frame member, wherein the top drive device is arranged generally within the opening in the loop shaped frame, and wherein the top drive device comprises:

- a gearbox or transmission housing,
- a first, e.g. left-hand, and a second, e.g. right-hand, top drive motor, which motors are arranged underneath the gearbox or transmission housing, wherein the first and second top drive motors are arranged seen in vertical projection on opposed sides of the lower frame member.

This arrangement allows for easy access to the top drive motors, e.g. in view of their servicing and/or replacement which may involve one or more of the measures discussed herein with reference to the first aspect of the invention. If, as preferred the frame allows for unhindered access to the top drive motors from below, one can also envisage that, e.g. for replacement of a motor, the trolley is lowered until a motor is made to rest on a carrier that is transportable onto the drill floor. For example the carrier is a skid cart, e.g. that is transportable of associated rails to a position underneath the trolley so as to receive a top drive motor as the trolley is lowered towards the drill floor. The motor can then be made to rest on the carrier and detached from the rest of the top drive device, e.g. from the gearbox or transmission housing, and transported away, e.g. to a maintenance room. A spare motor can be brought to the drill floor using the same or a similar carrier, e.g. skid cart.

In an embodiment of the third aspect of the invention the lower frame members carries a rotatable head clamp assembly as described herein. Possibly the lower frame member is integrated with the rotatable head clamp assembly. Possibly said lower frame member with integrated rotatable head clamp assembly is releasably secured to the first and second frame members.

In an embodiment of the third aspect of the invention the rotatable head clamp assembly including the thrust bearing is embodied as an exchangeable unit, e.g. with a housing wherein the thrust bearing and the open-centered body of the assembly are mounted and wherein said housing is placed in a receptor of the lower frame member, e.g. the receptor being an open topped cavity in the lower frame member.

In an embodiment of the third aspect of the invention the top drive device is mounted on or within the frame so as to be vertically mobile relative to the frame by one or more vertical displacement actuators, e.g. adapted to perform controlled lowering and raising of the top drive device during make up or breaking of the threaded connection between the quill or rotary stem on the one hand and the tool joint or box member of the tubular suspended from the rotatable head clamp assembly on the other hand.

In an embodiment of the third aspect of the invention a flexible first drilling fluid hose that is suspended from an elevated position and hangs in an open loop is connectable at an end thereof to a rigid pipe piece that is fitted on the trolley, and wherein a shorter, flexible second drilling fluid hose is connected between said rigid pipe piece and the vertically mobile top drive device, e.g. to a fluid swivel thereof.

The third aspect of the invention also relates to a wellbore drilling top drive device comprising:

- a gearbox or transmission housing,
- a vertical axis top drive motors, e.g. electric motors, which motors are mounted underneath the gearbox or transmission housing at opposed sides, e.g. lateral sides, of the top drive device,
- a rotary stem or quill extending downward from the gearbox or transmission housing in a space between said downward depending top drive motors,
- a drilling fluid swivel arranged on the top side of the housing.

In a further development said combination also comprises a rotatable head clamp assembly as described herein.

In a further development the combination comprises one or more vertical actuators that allow to vertically displace the rotary stem or quill, e.g. the entire top drive device, relative to the rotatable head clamp assembly for make-up or break up of a threaded connection between the rotary stem or quill on the one hand and a tool joint or box member of a tubular retained by the rotatable head clamp assembly.

A fourth aspect of the invention relates to a wellbore drilling trolley provided with a top drive device, wherein the trolley is adapted to be guided along at least one vertical trolley rail and wherein the trolley comprises a frame, wherein the top drive device is attached to the frame of the trolley, said top drive device comprising:

- one or more top drive motors, e.g. electric top drive motors,
- a gearbox or transmission housing,
- a rotary stem or quill driven by said one or more top drive motors, said top drive device being adapted to impart rotary motion to a drilling tubulars string when connected to said rotary stem or quill of the top drive device, and wherein the top drive device is mounted so as to be vertically mobile relative to the frame by one or more vertical displacement actuators, e.g. adapted to perform controlled lowering and raising of the top drive device during make up or breaking of the threaded connection between the quill or rotary stem on the one hand and the tool joint or box member of a tubular on the other hand.

The wellbore drilling trolley of the fourth aspect may comprise on or more technical features discussed herein with reference to other aspects of the invention.

The fourth aspect of the invention also relates to a wellbore drilling installation provided with said drilling trolley, said wellbore drilling installation further comprising a drilling tower, e.g. a mast, wherein a flexible first drilling fluid hose is suspended from an elevated position of the drilling tower and hangs in an open loop, which first drilling fluid hose is connected at an end thereof to a rigid pipe piece that is fitted on the frame of the trolley, and wherein a shorter, flexible second drilling fluid hose is connected between said rigid pipe piece and the vertically mobile top drive device, e.g. to a fluid swivel thereof.

In an embodiment of the trolley of the fourth aspect of the invention a rotatable head clamp assembly as described herein is provided and supported by the frame of the trolley, below the rotary stem or quill of the top drive device.

The present invention also relates to well drilling installations, combinations, top drive devices, and/or methods, etc. comprising a combination of features of the aspects of the invention, e.g. as described in the appended claims and/or as shown in the drawings.

The invention and aspects thereof will now be described with reference to the appended drawings.

DETAILED DESCRIPTION OF EMBODIMENTS

Figure 1:
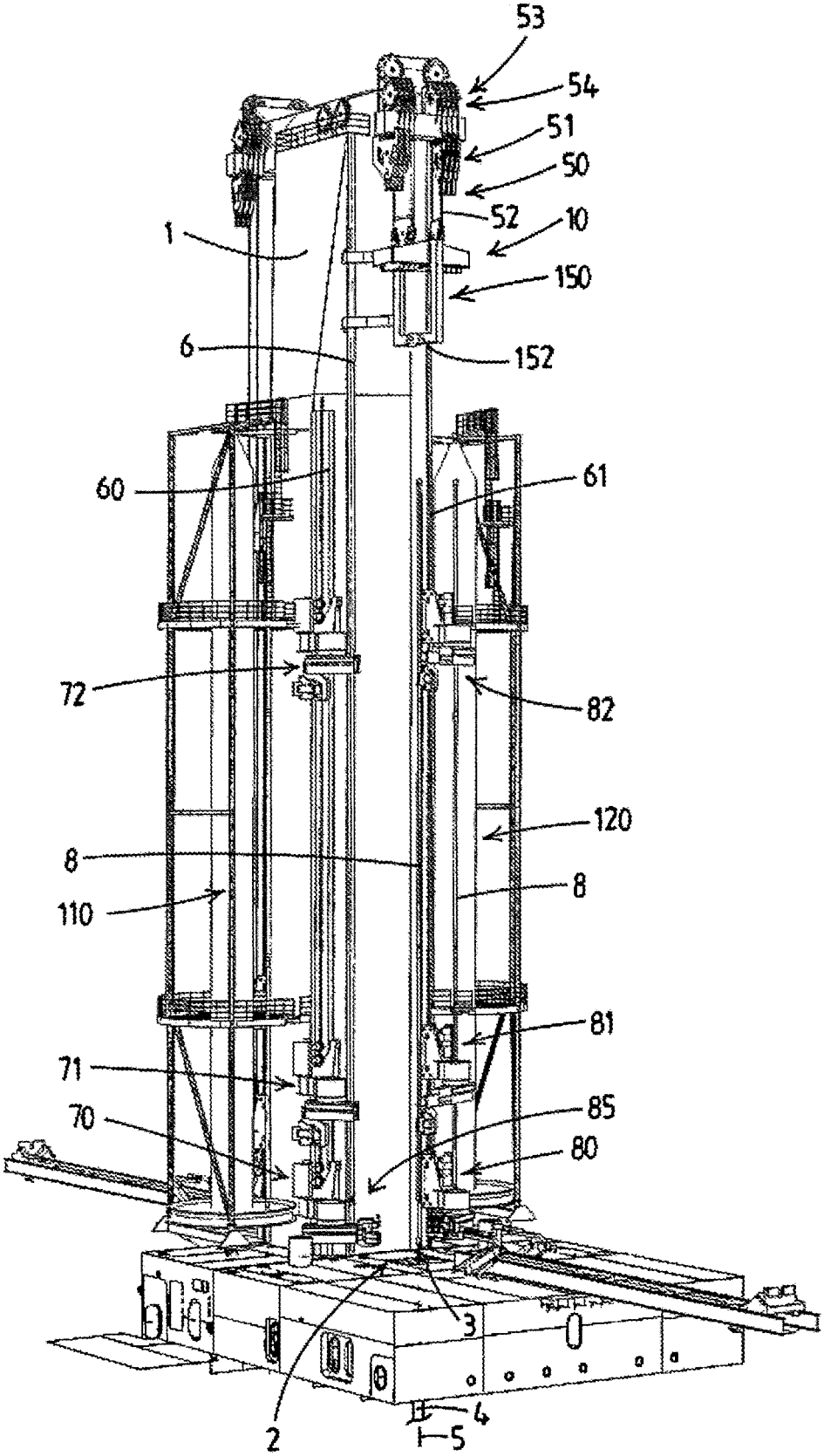
FIG. 1 shows a wellbore drilling installation with a top drive device according to the invention.

FIG. 1 shows a wellbore drilling installation with a top drive device according to the invention. It is envisaged that the depicted installation is part of an offshore drilling vessel for performing offshore drilling and/or other wellbore related activities, e.g. well intervention.

As will be clear from the following description FIG. 1 only shows the trolley with the top drive device removed for reasons of clarity. Other figures do show the ensemble of the trolley and the top drive device.

The installation comprises a drilling tower 1 that is here embodied as a mast with a closed contoured steel structure with at least one firing line outside of the mast itself. For example the mast is arranged adjacent a moonpool of a drilling vessel, or over a larger moonpool with two firing lines along opposed outer faces of the mast 1 as is known in the art.

In an alternative design the drilling tower is embodied as a derrick with the firing line within the structure of derrick, e.g. the derrick having a lattice structure placed over the moonpool.

FIG. 1 shows a drill floor 2 having a well center 3, e.g. with a slip device arranged at said location, through which a drilling tubulars string 4, 8 can pass along a firing line 5.

The mast 1 is at the side of the drill floor 2 provided with two parallel vertical trolley rails 6, 7. A trolley 10 is guided along the trolley rails 6, 7.

A top drive device 30 is attached to the trolley 10.

The top drive device 30 comprises in this example two electric top drive motors 31, 32 which commonly drive, via gearbox or transmission in housing 33, a rotary stem or quill 34. As known in the art the quill 34 is connectable, e.g. via a threaded connection, e.g. via a saver sub, to the top end of a drilling tubular aligned with the firing line. Thereby the top drive device 30 is able to impart rotary motion and drive torque to a drilling tubulars string.

A hoisting device 50 is provided that is adapted to move the trolley with the top drive device up and down along the vertical trolley rails 6,7.

A left-hand motion arm rail 60 and a right-hand motion arm rail 61 are present on opposed lateral sides of a vertical path of travel of the trolley 10 with the top drive device 30 along said the vertical trolley rails 6,7.

On each of said motion arm rails 60, 61 at least one, here three as is preferred, motion arm assembly 70, 71, 72, 80, 81, 82 is arranged. Each assembly is, as preferred independently controlled from any other assembly on the same rail 60, 61, vertically mobile along the respective rail by a respective motion arm assembly vertical drive.

Figure 3B:
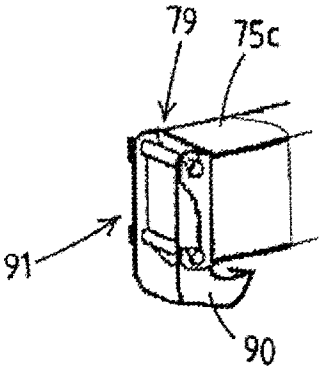
FIG. 3B illustrates the cooperation of the mechanical coupler parts of the motion arm and the tubular gripper member of FIG. 3A, FIG. 3*c* schematically shows an electric top drive motor provided with a mechanical coupler part adapted to be coupled to a mechanical coupler part on the motion arm.
Figure 3C:
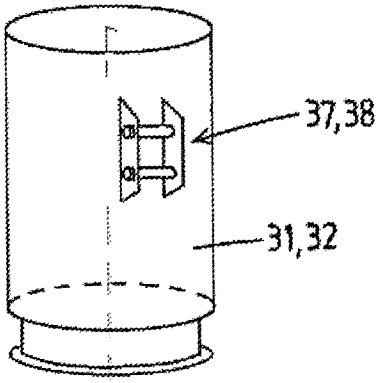
FIG. 3A illustrates a motion arm assembly of the installation of FIG. 1 provided with a tubular gripper member.
Figure 3A:
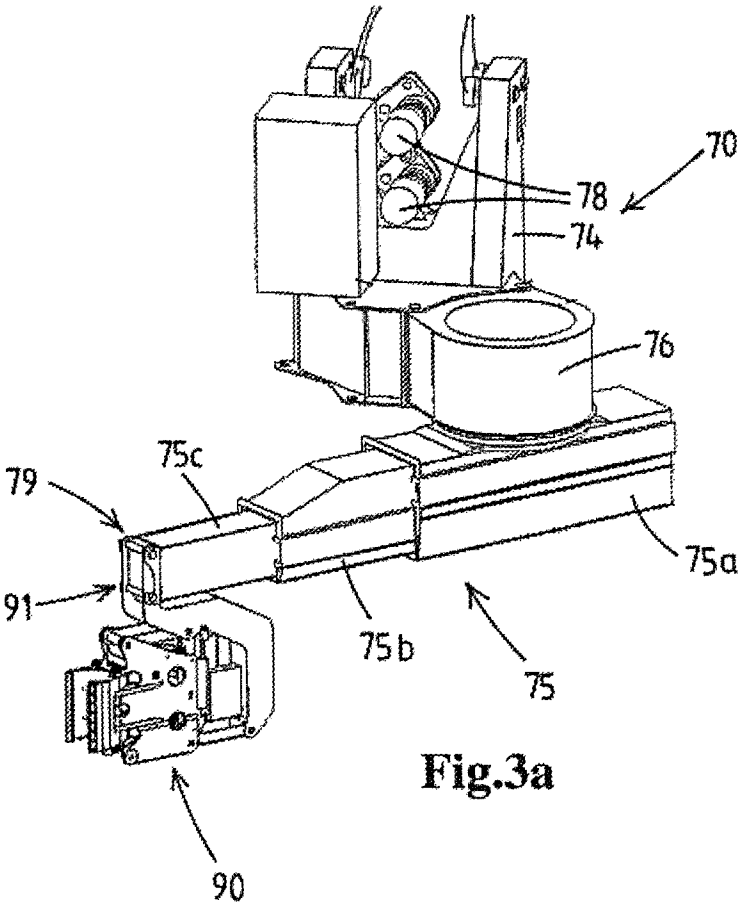

FIG. 3A illustrates a possible embodiment of a motion arm assembly 70, with, as is preferred, the other assemblies 71, 72, 80, 81, 82 of the same design.

The assembly 70 is the lowermost assembly on rail 60. The assembly 70 comprises a base 74 that is mounted mobile on the rails 60.

The assembly further comprises an extensible and retractable motion arm 75, here a telescopic arm with a first arm section 75*a* connected to the base 74, and one or more, here two, telescopic second and third arm sections 75*b*, 75*c*. For example the arm sections are extensible by associated hydraulic cylinders of the arm 75. The motion arm has an operative reach that encompasses the firing line so that the arm can handle drilling tubulars and/or well center equipment, or other tooling that needs to be presented or held in the firing line.

As is preferred the arm 75, here the first arm section 75*a*, is connected to the base 74 via a slew bearing 76 allowing to rotate the arm about a vertical axis by means of an associated slew drive.

The assembly 70 further comprises a motion arm assembly vertical drive, here with one or more motors 78 each driving a pinion meshing with a rack that extends along the rail 60. Thereby the base can move along the at least one vertical motion arm rail and the drive with motors 78 is sufficiently strong to do so while the motion arm assembly carries a load in the firing line of at least 1000 kg, preferably at least 5000 kg.

At the end of the motion arm 75, here at the end of third section 75*c*, a mechanical coupler part 79 is provided.

By means of the coupler part the motion arm assembly 70, here each of the depicted motion arm assemblies, is able to support at least one of a well center tool, e.g. an iron roughneck tool 85, or a tubular gripper member 90, and allowing to bring said well center tool or tubular gripper member in the firing line.

For this reason each of said tubular gripper members 90 and/or the iron roughneck tool 85 is provided with a mechanical coupler part 91 (see FIG. 3B) that is adapted to be mated with the mechanical coupler part 79 that is fitted on the motion arm 75 such that the respective gripper member, iron roughneck tool, or other well center tool, becomes fixed to the respective motion arm and fully and directly follows any motion of the motion arm.

Figure 2B:
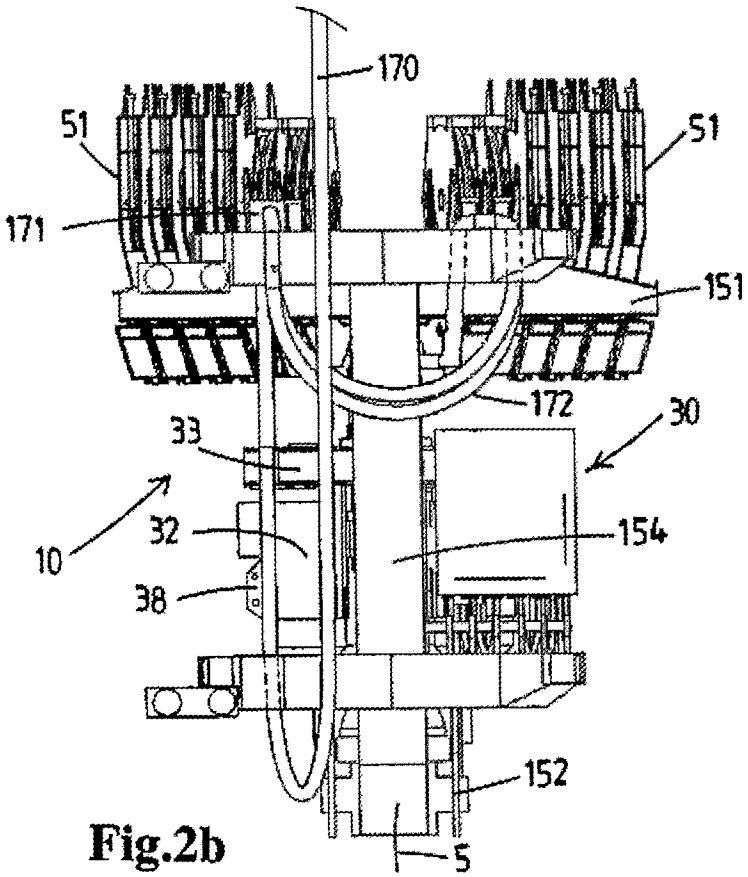
FIG. 2B shows in view from the rear the trolley and top drive device of the installation of FIG. 1.
Figure 2A:
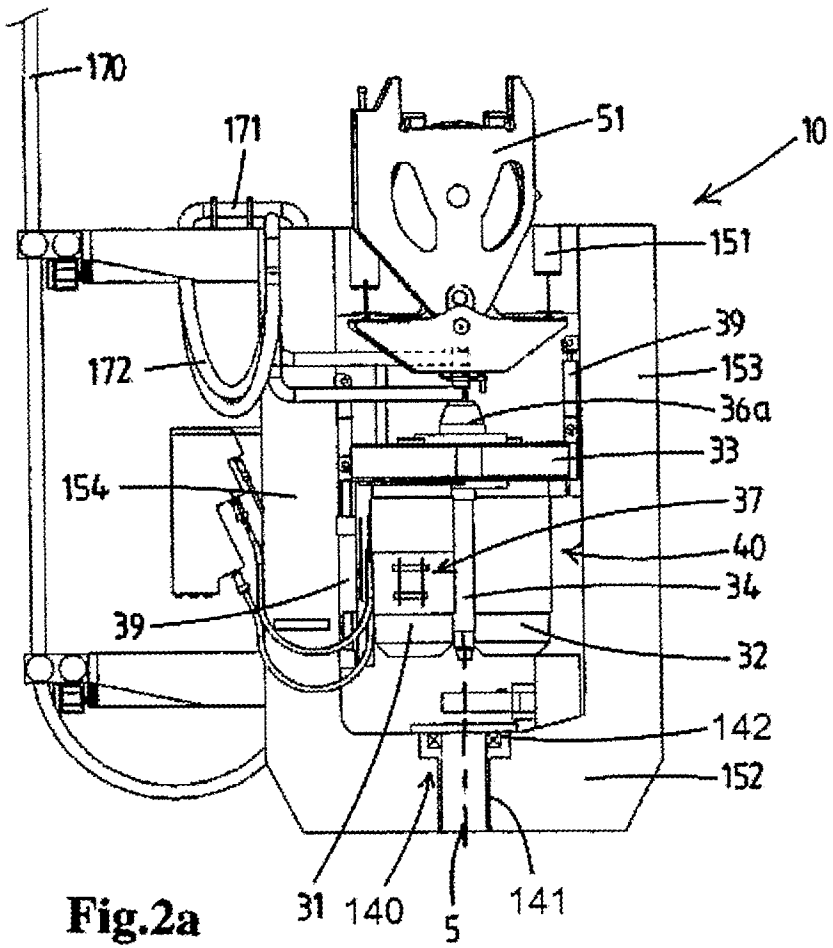
FIG. 2A shows in side view the trolley and top drive device of the installation of FIG. 1.

As illustrated in FIGS. 2A, 2B, and 3C it is envisaged that each top drive motor 31, 32 is also provided, e.g. permanently or only temporarily during servicing, with a mechanical coupler part 37, 38 that is adapted to be mated with the mechanical coupler part 79 that is fitted on the motion arm 75 of assembly 70 such that the motor can be fixed to the motion arm and fully and directly follows any motion of the motion arm.

The motion arm is designed carry the weight of the top drive motor 31, 32 as the motor is disconnected from the rest of the top drive device 30 and, preferably, also to transport said motor vertically by means of the drive with one or more motors 76.

As depicted it is envisaged that the coupler parts 79, 37, 38 allow to connect the motor 31, 32 to the arm 75 by means of a vertical relative motion, e.g. with one or more hook portions of the coupler part 79 engaging from beneath under corresponding lifting bosses or a lifting pin on the motor 31, 32. It will be appreciated that other mechanical coupler arrangements are also possible to obtain the desired direct mechanical coupling between the motor and the arm 75.

In a less preferred embodiment there is no direct mechanical fixation of the top drive motor 31, 32 to a respective motion arm and instead a rope sling or other similar flexible member is used to suspend the motor from the motion arm. This suspension from the arm by a flexible element, e.g. a cable, however does not allow to make full use of the motion control and stability of the motion arm for positioning of the motor, which is in particular disadvantageous in offshore applications where vessel motion may become problematic.

It is envisaged that the top drive motors 31, 32 are mounted in the top drive device to be arranged on the respective left-hand and right-hand lateral sides thereof, allowing one or more of the left-hand motion arm assemblies 70, 71, 72 to be used to remove a left-hand side top drive motor 31 and one or more of the right-hand side motion arm assemblies 80, 81, 82 to be used to remove a right-hand side top drive motor 32.

It is envisaged that, e.g. in case of a failure of one of the top drive motors 31, 32 and/or the need to gain access to the gearbox or transmission housing by removal of a motor, a motion arm assembly, e.g. a lowermost assembly 70, 80, is used in the process of removal of the top drive motor from the top drive device whilst the rest of the top drive device remains attached to the trolley 10.

In this removal process, for example, the trolley 10 is lowered so that it is closely above the drill floor 2. Then the motion arm assembly 70, with any well center tool and/or tubular gripper member removed therefrom, is operated so that the top drive motor 31 is within the operative reach of the motion arm 70. Then the motion arm 75 is extended to reach the top drive motor 31 and the top drive motor 31 is connected to the motion arm 75 by mating coupler part 79 with the respective coupler part 37 of the drive motor 31. Then the motion arm 75 is used to support and/or lift, lower this top drive motor 31 upon disconnection thereof from the rest of the top drive device. For example the arm retains the motor 31 whilst the trolley and/or the rest of the top drive device are lifted to clear the motor 31 from the rest of the device 30.

In an embodiment it is envisaged that, if the motion arm assembly on one side is used to couple with and remove a top drive motor, a motion arm assembly on the other side is used to stabilize the top drive device and/or the trolley. For example this other motion arm assembly couples to the top drive motor on the other side of the top drive device, which motor is not to be removed, and/or onto the housing of the gearbox/transmission, and/or onto a part of the trolley or frame thereof. For example the frame of the trolley is equally provided with one or more mechanical coupler parts that can be mechanically fixed to a mechanical coupler part on a motion arm of one or more of the assemblies 70, 71, 72, 80, 81, 82.

It is envisaged, in an embodiment that the installation comprises a spare top drive motor and a spare top drive motor storage compartment within the operative reach of a motion arm assembly, e.g. a lowermost assembly on one of the rails 60, 61. Preferably this spare motor is provided, either permanently or temporarily, with a mechanical coupler part that is to be mated with the mechanical coupler part 79 on the motion arm to cause the fixation of the spare top drive motor to the respective motion arm. Preferably the motion arm is adapted to be used to move the spare top drive motor out of the compartment and then bring it to the top drive device, where the spare top drive motor can be fitted to the top drive device as a replacement of a faulty top drive motor.

As depicted there are two one tubulars storage racks 110, 120, each along a respective side of the mast 10. These racks 110, 120 are each adapted to store multi-joint tubulars, here triples 8 (about 36 meter), therein in vertical orientation.

It is illustrated that two of the motion arm assemblies 71, 72, 81, 82 on each vertical rail 60, 61 are equipped with a tubular gripper 85. The height of the rails 60, 62 is at least such that the upper assembly 72, 82 can be arranged to grip the tubular in the storage rack 110, 120 at an appropriately high location.

The assemblies with grippers 85 can be operated in unison to act as part of the tubular racker device allowing to transfer drilling tubulars, e.g. drill pipe or casing pipe or other drilling tubulars between the firing line and the respective storage rack 110, 120.

The trolley 10 is provided with a rigid frame 150 that supports the top drive device 30.

Generally in the depicted preferred embodiment the frame 150 forms a rigid loop in a central vertical plane through the firing line 5 and perpendicular to the adjacent side of the mast and/or the plane through the rails 60, 61.

The frame 150 has a top frame member 151 that is suspended from one or more winch driven cables of the hoisting device 50. Here, as preferred, the top frame member 151 carries multiple travelling sheaves 51 in a side-by-side arrangement, with the sheaves 51 having a common, horizontal, axis of rotation. The one or more hoisting cables 52 extend between these travelling sheaves 51 and sheaves 53 of the crown block 54, from which the one or more cables 52 pass to one or more winches (not shown). As is preferred a heave compensation mechanism is provided that acts on the one or more cables 52 to afford heave compensation of the trolley 10 and the attached top drive device 30.

The frame comprises a lower frame member 152, spaced below the top frame member 151, that is rigidly connected via a front frame member 153 and a rear frame member 154 to the top frame member 151.

The lower frame member 152 extends perpendicular to the axis of rotation of the multiple sheaves 51 on the top frame member. This embodiment is e.g. advantageous in combination with a top drive device wherein two vertical axis electrical top drive motors 31, 32 are arranged underneath a gearbox or transmission housing 33, e.g. a left-hand motor and a right-hand motor as shown.

The housing 33 is guided along the frame members 153, 154, e.g. by guide rails thereon, e.g. also absorbing reaction torque of the drive motors 31, 32.

As is preferred these motors 31, 32 are in vertical projection on opposed sides of the lower frame member 152. The removal of these motors 31, 32 in the manner described herein, or in another manner, is facilitated as the motors 31, 32 can, once detached from the housing 33, easily be lowered relative to the gearbox or transmission housing. It will be appreciated that said lowering can be performed by raising the trolley and/or lowering the respective motion arm assembly.

The lower frame member 152, e.g. embodied with two parallel lower frame girders, supports a rotatable head clamp assembly 140 that is provided with an open-centered body 141 with a vertical passage there through that allows to lower the head clamp assembly 140 from above over the top end of a tubular 8 in the firing line 5, e.g. positioned in the firing line by a racker device with gripper members 90 during drilling operations or the top end of the tubular string suspended from a drill floor mounted slip device.

The rotatable head clamp assembly is provided with a tool joint retainer assembly, e.g. with retainers engaging underneath a shoulder of the tool joint or box member of the tubular, that is embodied to axially retain the tool joint or box member at the top of the tubular whilst the tool joint or box remains accessible for the quill 34 or rotary stem of the top drive device 30.

As is preferred the rotatable head clamp assembly is provided with a thrust bearing 142 adapted to support the load of the drilling tubular string 4 during a drilling process, when the quill 34 or rotary stem of top drive device is connected to the tool joint or box member of the top end of the drilling string, e.g. by a threaded connection, e.g. using a saver sub. This arrangement allows to dispense with the thrust bearing in the top drive device itself, and mount said thrust bearing in or on the lower frame member of the frame. The rotatable head clamp assembly can thus rotatably support an entire tubular string and allow for rotary motion thereof which is imparted by the rotary stem or quill of the top drive device.

The provision of the rotatable head clamp assembly 140 with thrust bearing 142 separated from the structure of the top drive with transmission and one or more top drive motors 31, 32 allows for reduced complexity of the top drive device 30 compared to existing devices wherein the thrust bearing is within the housing of the device 30 and very difficult to access and exchange.

The rotatable head clamp assembly 140 including the thrust bearing 142 preferably is embodied as an exchangeable unit, e.g. with a housing wherein the thrust bearing and the open-centered body of the assembly are mounted and wherein said housing is placed in a receptor of the lower frame member 152. For example the receptor is an open topped cavity in the lower frame member.

For example the rotatable head clamp assembly 140 is designed to handle a firing line load of at least 1000 tonnes.

Reference numeral 190 indicates a wrench device that allows to retain the tool joint or box member held by the assembly 140 when make-up or break-up of a threaded connection is performed.

The top drive device 30 is mounted within the frame 150 so as to be vertically mobile relative to the frame by one or more vertical displacement actuators 39, e.g. adapted to perform controlled lowering and raising of the top drive device during make up or breaking of the threaded connection between the quill 34 or rotary stem on the one hand and the tool joint or box member of the tubular suspended from the rotatable head clamp assembly 140 on the other hand.

Figure 6:
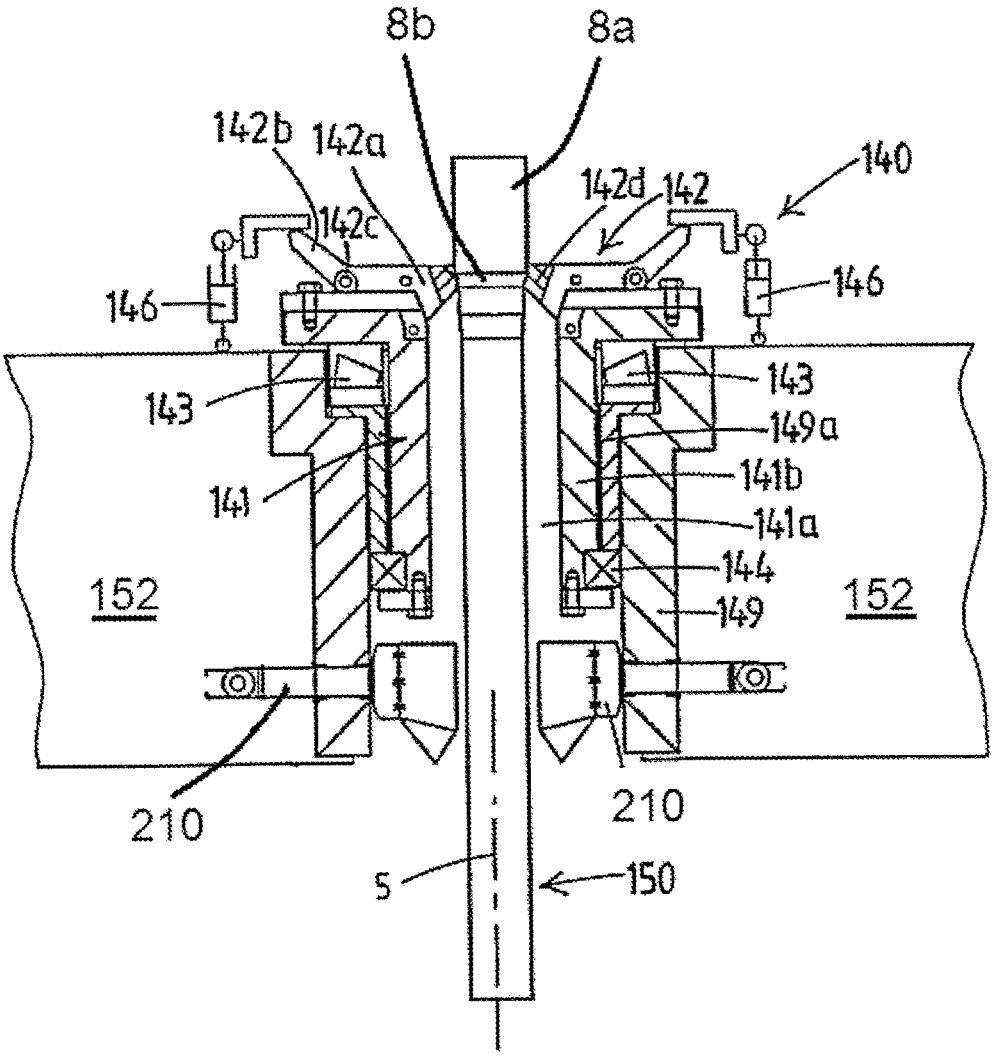
FIG. 6 illustrates an example of the rotatable head clamp assembly, FIGS. 7*a-c* further illustrate the rotatable head clamp assembly of FIG. 6.
Figure 7C:
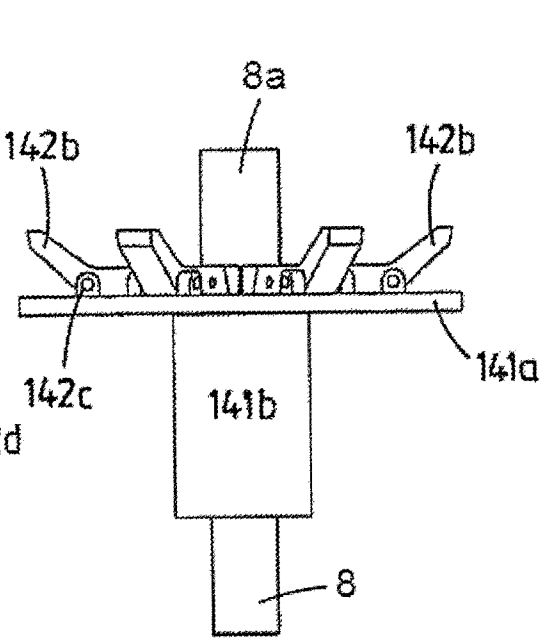
Figure 7B:
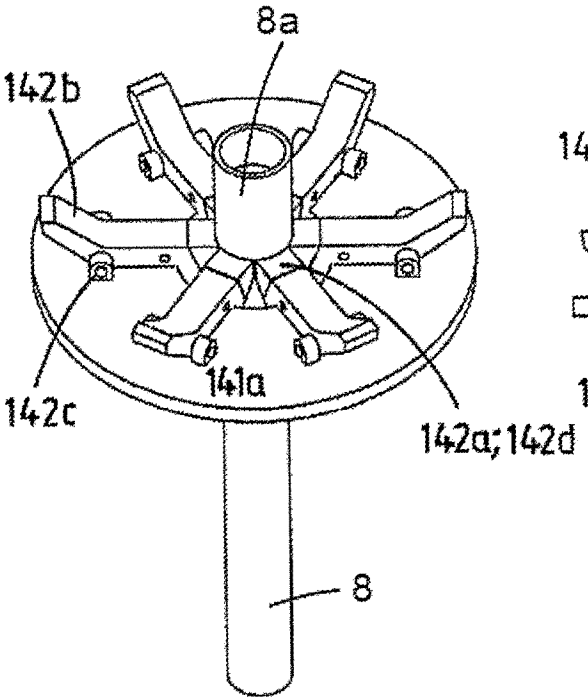
Figure 7A:
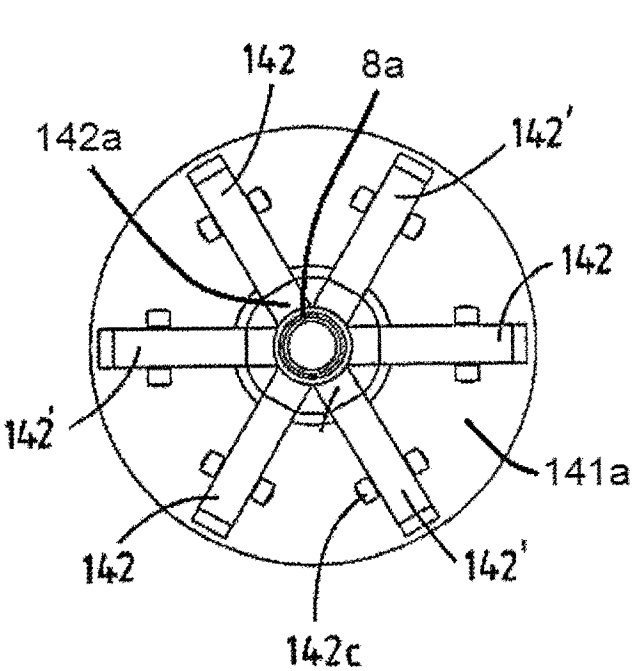

With reference to FIGS. 6, 7*a* c, now an embodiment of the rotatable head clamp 140 will be discussed in more detail.

The head clamp 140 here comprises:

- a rotary open-centered body 141 defining a vertical passage 141*a* in line with firing line 5 to allow passage of a pipe or tubular of a drill string in firing line 5, e.g. a special sub fitted to the top end of the drill string or drill pipe to be added to the drill string and having at a top end thereof a tool joint or box member similar to tubulars making up the drill string;
- a thrust bearing 143 supporting the rotary body 141, allowing rotation thereof under the full load of the drilling tubulars string hanging along the firing line 5 in the wellbore; for example the thrust bearing has a load rating of 1000 tonnes or more;
- multiple mobile retainers 142 supported by the rotary body 141 so as to provide an operative and a non-operative mode of the rotatable head clamp 140.

In the shown embodiment, the rotatable head clamp 140 comprises a housing 149 supporting the thrust bearing 143, which housing is supported by the lower frame member 152. Alternatively, the lower frame member 152 supports the head clamp 140 directly via the thrust bearing 143. Either way, the lower frame member 152 absorbs the load of the suspended drill string, which is then transmitted via the frame members 153, 154 directly to the top frame member 151. The top frame member 151 is suspended from a hoisting device, e.g. a winch and cable hoisting device, here with travelling sheaves 51 attached to said top frame member 151. The vertical load or weight of the drill string suspended in the firing line 5 from the head clamp 140, and thus supported by the thrust bearing 143, does not pass through the top drive device 30, allowing for a simple and more lightweight structure of the top drive device 30, e.g. of the gearbox or transmission housing thereof.

Here, the rotary body 141 is embodied as a cylinder 141*b* with a flanged top end 141*a* supporting the mobile pipe retainers 142. The thrust bearing 143 supports the flanged top end 41*a* of the rotary body.

Furthermore, in the shown embodiment and as preferred, an additional radial load bearing 144 is provided at the bottom end of the rotary body 141. A bearing connection 149*a*, which is a static frame part optionally integrated with housing 149, connects the thrust bearing 143 at the upper side of the rotary open-centered body with bearing 144 at the bottom end thereof.

In the shown embodiment, the lower frame member furthermore supports a centralizer, with one or more centralizer members 210, which is arranged below the head clamp 140 to centralize the drill string. Such centralizers are known in the art.

Figure 4:
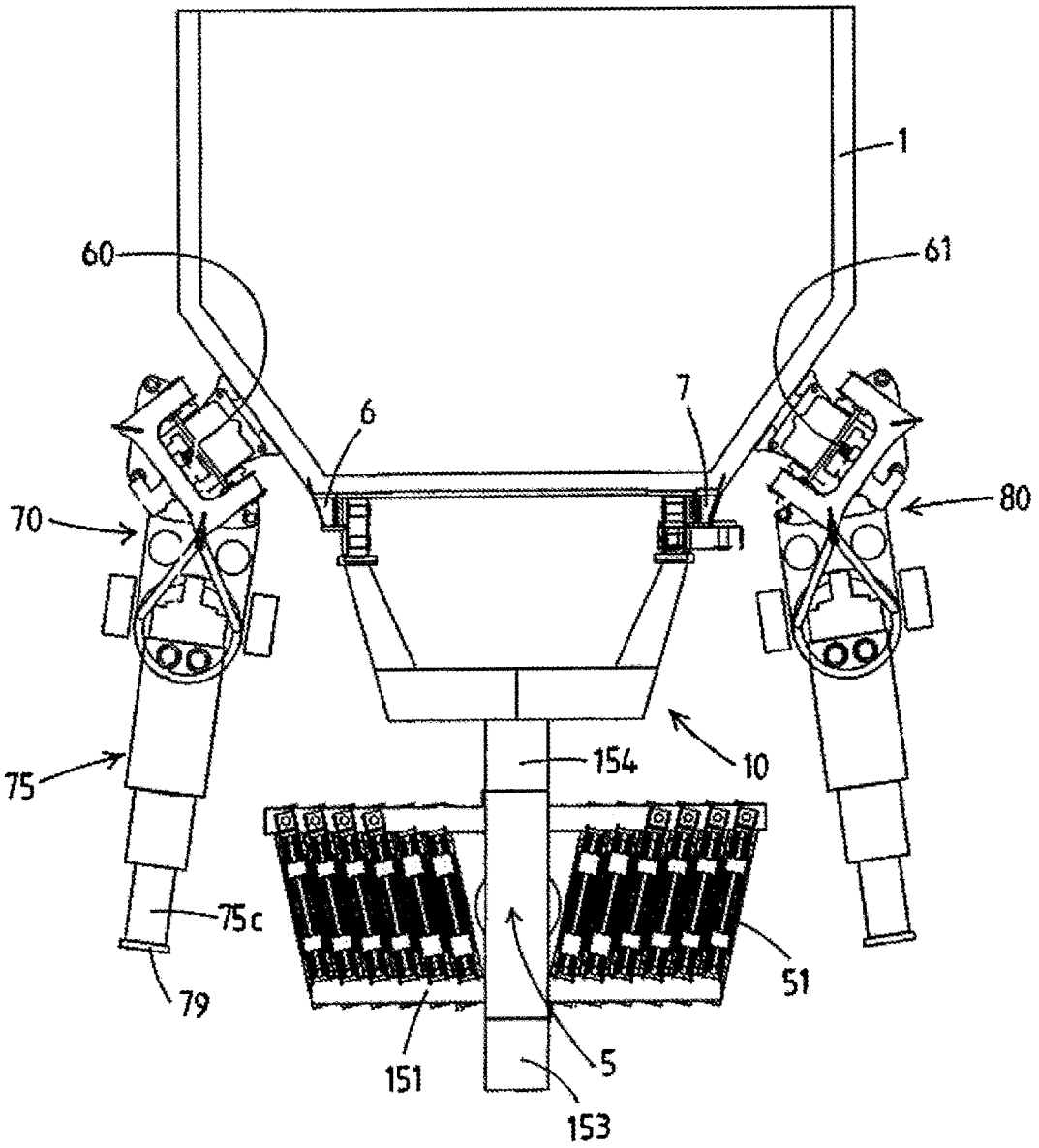
FIG. 4 illustrates from above the drilling tower, trolley, and motion arm assemblies of the installation of FIG. 1.
Figure 5:
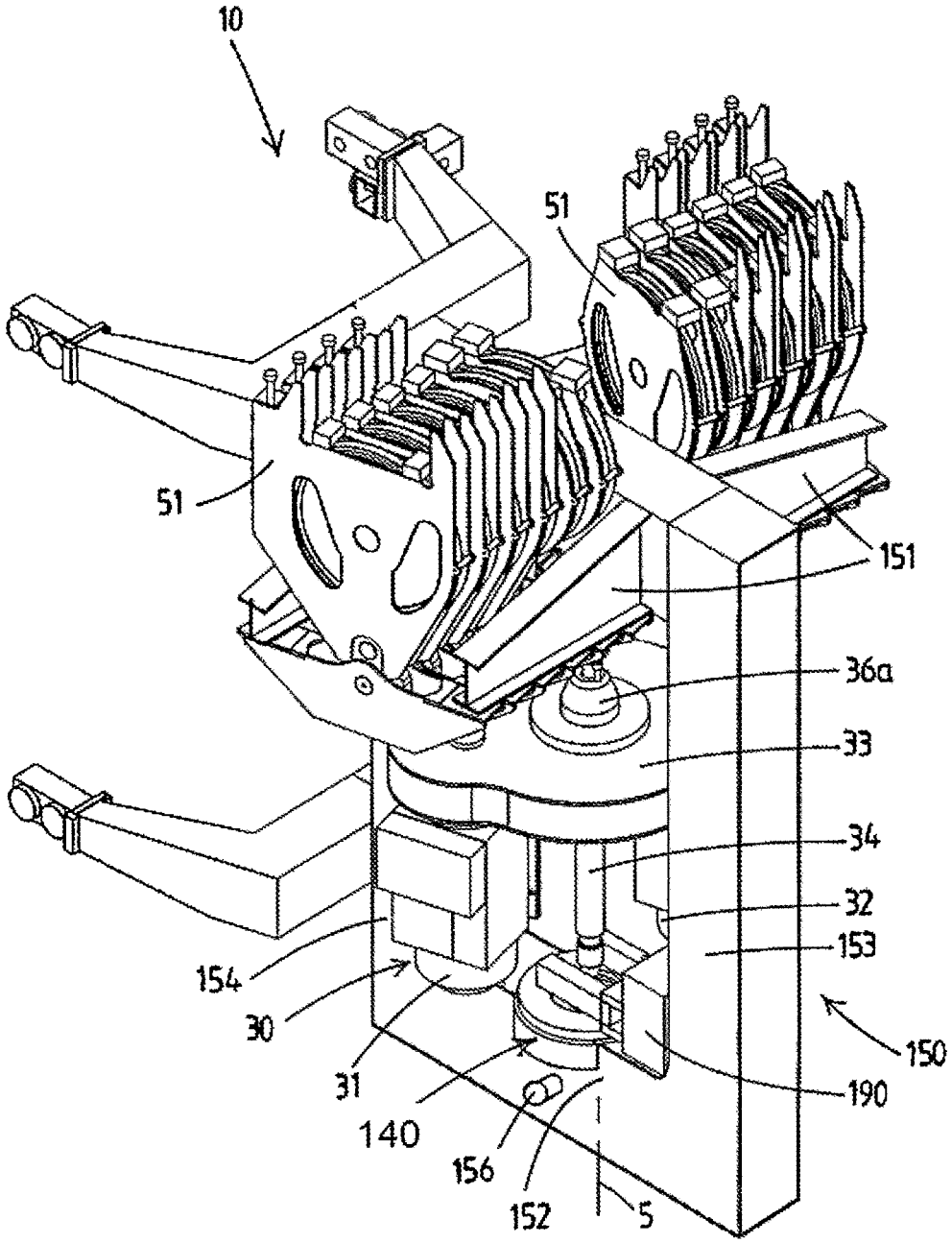
FIG. 5 shows the trolley and top drive device of the installation of FIG. 1 in perspective view.

The mobile retainers 142 are movable between a non-operative position and an operative position. In the non-operative position (not shown) the retainers 142 allow passage of a pipe of the drill string, e.g. a special sub fitted to the drill string, through the passage 141*a*. In the operative position as shown in FIG. 4, the retainers 142 engage below a shoulder 8*b* of the tool joint or box portion 8*a* of a pipe or tubular, e.g. special sub, of the drill string 8 extending through the passage 141*a* so as to suspend said drill string therefrom.

In the shown embodiment, the mobile retainers 142 each have a jaw 142*a* to engage on a drilling tubular near or at the shoulder of the tool joint, which is preferably an exchangeable jaw to be able to match the diameter and/or shape to the type of pipe.

In FIGS. 7*a-c* a possible embodiment of a head clamp is shown in top view, a perspective top view and a side view. This head clamp is provided with two sets each three mobile pipe retainers 142 and 142' respectively. Each set is adapted to retain a different type of pipe. This is advantageous as it is possible to have one set in the non-operative position and the other in the operative position.

The mobile retainers 142, 142' of FIG. 6 and FIG. 7*a-c* are, by way of example, embodied as a pivotal lever comprising an arm and a fulcrum, which fulcrum 142*c* is fixed to the rotary body 141, here on a flange 141*a* thereof. One end 142*a* of the arm is adapted to in the operative position engage on the pipe or tubular. Here, this end 142*a* of the arm is provided with clamping jaws 142*d*. In the non-operative position has cleared the area in line with the pipe passage to allow the passage of a pipe of the drill string. The other end 142*b* of the arm is operable by an actuator 146 to move the opposite end of the arm between the operative and the non-operative position. Here, the actuator 146 is embodied as a hydraulically operable finger engaging on the arm end 142*b*.

A flexible first drilling fluid hose 170 is suspended from an elevated position on the tower 10 and hangs in a loop and is connected at the other end to a rigid pipe piece 171 that is fitted on the trolley. A further, much shorter, flexible second drilling fluid hose 172 is connected between said rigid pipe piece 171 and the vertically mobile top drive device 30, e.g. to the fluid swivel 36*a* thereof. It will be appreciated that the latter fluid hose 172 can be rather short. The same arrangement can be provided for any hydraulic and/or electric lines that are to be connected to the top drive device. In this manner the vertically mobile top drive device is not subjected to the weight of the long first drilling fluid hose and other lines, which weight may be substantial if the drilling installation is e.g. embodied to handle triples or quads.

It is illustrated that the top drive device comprises a gearbox or transmission housing 33 and two or more vertical axis electric motors 31, 32 mounted to this housing, here one motor at each lateral side of the top drive device 30. The one or more vertical axis electric motors 31, 32 are arranged underneath the gearbox or transmission housing 33, e.g. each on a lateral side of the top drive device, with the rotary stem or quill 34 extending downward from the gearbox or transmission housing 33 in a space between said downward depending top drive motors 31, 32. This arrangement may allow for a reduction of the height of the top drive device 30 and/or of the related frame 150.

The trolley is connected, here as permanently welded structure, to the rear frame member 154.

In an embodiment it is envisaged that a motion arm assembly is employed to couple with a removable rotatable head clamp assembly 140, e.g. one or more rope slings being fitted between the motion arm assembly 140 and the rotatable head clamp assembly. In another embodiment it is envisaged that a mechanical coupler part is temporarily secured to the removable head clamp assembly 140 allowing for direct mechanical connection to a mating coupler part 79 on the motion arm.

Preferably the top drive device 30 can be raised by means of actuators 39 relative to the rotatable head clamp assembly 140 over such a height that the head clamp assembly 140 can be lifted out of an open topped receptor cavity in or on the lower frame member.

The frame 150 and hoisting device 50 preferably have sufficient strength and capacity to also handle a weight of a subsea riser string when appropriate. For example a riser lifting tool can be attached to the lower frame member 152 of the frame, e.g. the lower frame member 152 having connection stubs 156 at opposed side thereof from which a riser lifting tool can be suspended.

For example the frame 150 and hoisting device 50 have sufficient strength and capacity to handle a load of 1000 tonnes or more in the firing line.

Figure 8:
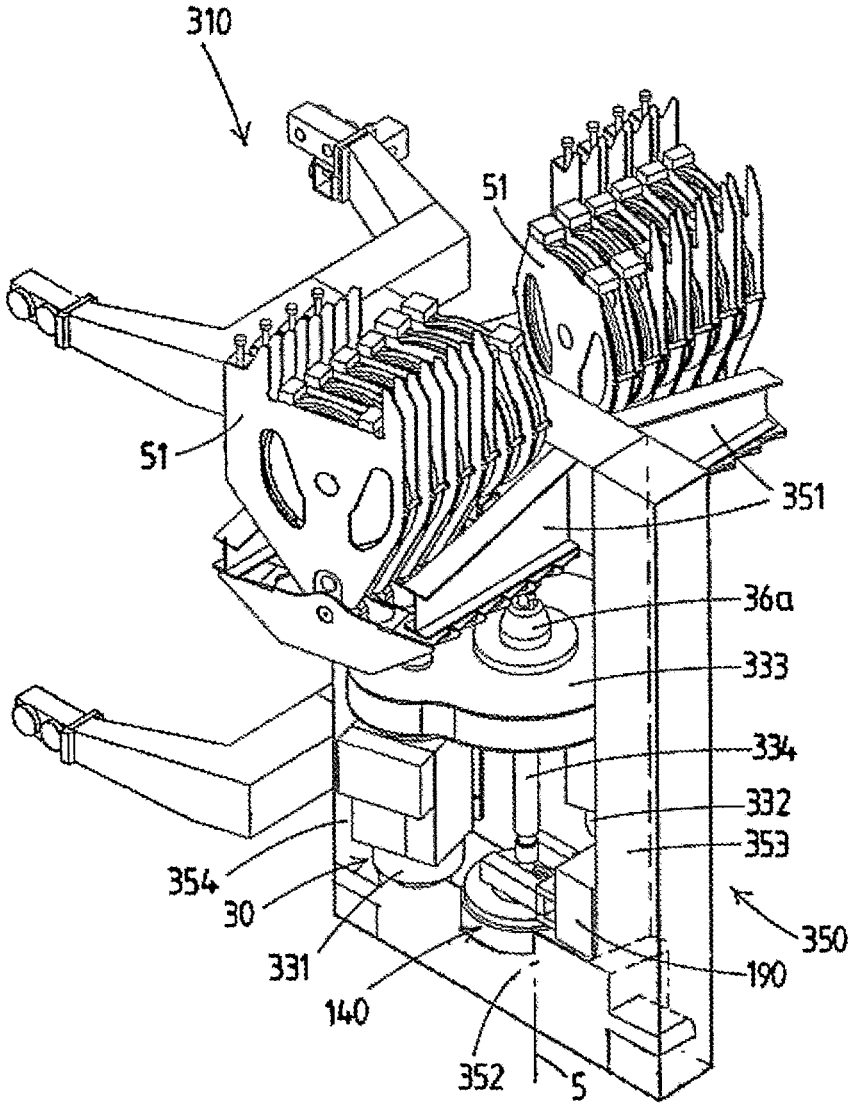
FIG. 8 shows an alternative embodiment of the trolley and top drive device of the installation of FIG. 1 in perspective view.

FIG. 8 depicts an alternative trolley 310, in particular an alternative frame.

The trolley 310 is provided with a rigid frame 350 that supports the top drive device 30. Generally, in the depicted embodiment, the frame 350 forms a rigid loop in a central vertical plane through the firing line 5 and perpendicular to the adjacent side of the mast and/or the plane through the rails 60, 61.

The frame 350 has a top frame member 351 that is suspended from one or more winch driven cables of the hoisting device 50. Here, as preferred, the top frame member 351 carries multiple travelling sheaves 51 in a side-by-side arrangement, e.g. with the sheaves 51 having a common, horizontal, axis of rotation. The one or more hoisting cables extend between these travelling sheaves 51 and sheaves of the crown block, from which the one or more cables pass to one or more winches (not shown). As is preferred a heave compensation mechanism is provided that acts on the one or more cables to afford heave compensation of the trolley 310 and the attached top drive device 30.

The frame here comprises a releasable lower frame member or rotatable head clamp carrier 352, that is spaced below the top frame member 351.

The lower frame member or rotatable head clamp carrier 352 is connected via frame member 353 and frame member 354 to the top frame member 351, so that the vertical load absorbed by the thrust bearing in the rotatable head clamp is passed directly via said frame members 353, 354 to the top frame member and does not pass through the top drive device 30.

As schematically shown it is provided for that the carrier 352 can be released from the lower end of the members 353, 354 in order to move the carrier, and the rotatable head clamp 140, away from underneath the top drive device 30.

The carrier 352 here extends perpendicular to the axis of rotation of the multiple sheaves 51 on the top frame member. This embodiment is e.g. advantageous in combination with a top drive device wherein two vertical axis electrical top drive motors 331 are arranged underneath a gearbox or transmission housing 333, e.g. a left-hand motor and a right-hand motor as shown. Another arrangement, e.g. with the carrier parallel to the top frame member 151 is also envisaged. In said embodiment the frame members 353, 354 will be embodied as left-hand and right-hand frame members of the frame.

The housing 333 of the top drive device 30 is guided along one or more of the vertical frame members 353, 354, e.g. by guide rails thereon, e.g. also absorbing reaction torque of the one or more drive motors 331.

Here these motors 331, 332 are in vertical projection on opposed sides of the lower frame member 352.

The top drive device 30 is mounted within the frame 350 so as to be vertically mobile relative to the frame by one or more vertical displacement actuators 39, e.g. adapted to perform controlled lowering and raising of the top drive device during make up or breaking of the threaded connection between the quill 334 or rotary stem on the one hand and the tool joint or box member of the tubular suspended from the rotatable head clamp assembly 140 on the other hand.

The frame of the trolley and hoisting device 50 preferably have sufficient strength and capacity to also handle a weight of a subsea riser string when appropriate. For example a riser lifting tool can be attached to the vertical frame members 18, 19; 353, 354, e.g. after removal of the carrier 19, 352 and then attached to said vertical frame members.

It will be appreciated in general, that with the carrier 19, 352 removed other components may become suspended from the first and second vertical frame members of the trolley frame.

It will also be appreciated that, if desired, a common elevator device may be attached to the frame, e.g. to the carrier 19, 352, e.g. for handling tubulars that are to be supplied by a catwalk machine.

The invention claimed is:

1. A method for servicing a top drive device of a wellbore drilling installation, wherein the installation comprises:

a drilling tower;

a drill floor having a well center for a drilling tubulars string passing through the well center along a firing line;

at least one vertical trolley rail;

a trolley, said trolley being guided along said at least one vertical trolley rail;

a top drive device attached to the trolley, said top drive device comprising one or more top drive motors, adapted to impart rotary motion to a drilling tubulars string when connected to said top drive device;

a hoisting device adapted to move the trolley with the top drive device up and down along said at least one vertical trolley rail;

a vertical motion arm rail;

a motion arm assembly comprising a base and an extensible and retractable motion arm, wherein the base is guided by said at least one vertical motion arm rail, and wherein the motion arm has an operative reach that encompasses the firing line, said motion arm assembly being adapted to support at least one of a well center tool or a tubular gripper member, and allowing to bring said well center tool or tubular gripper member in the firing line; and a motion arm assembly vertical drive which is adapted to move the motion arm base along said at least one vertical motion arm rail, wherein the method comprises removing one of the one or more top drive motors from the top drive device whilst the rest of the top drive device remains attached to the trolley, and wherein the removing comprises:

operating the motion arm assembly and/or the trolley so that the one top drive motor is within the operative reach of the motion arm;

operating the motion arm to reach the one top drive motor;

connecting the one top drive motor to the motion arm; and supporting, lifting or lowering the one top drive motor using the motion arm upon disconnection of the one top drive motor from the rest of the top drive device.

2. The method according to claim 1, wherein the one top drive motor is fitted, permanently or only temporarily during servicing, with a mechanical coupler part that is mated with a corresponding mechanical coupler part that is fitted on the motion arm such that the one top drive motor becomes fixed to the motion arm and fully and directly follows any motion of the motion arm.

3. The method according to claim 2, wherein the well center tool, and/or the tubular gripper member which is/are to be handled by the motion arm that is used in the removal of the one top drive motor is/are provided with a mechanical coupler part similar to a mechanical coupler part of the one top drive motor.

4. The method according to claim 1, wherein the motion arm that is to be used in said removal of the one top drive motor during said servicing is, during a wellbore drilling process, positioned along the at least one vertical motion arm rail in a position near the drill floor to support an iron roughneck tool above the well center, and wherein, before removing the one top drive motor, the trolley is lowered towards the drill floor so that the one top drive motor is within operative reach of said motion arm, and then said motion arm, with the iron roughneck tool detached from the motion arm, is connected to the one top drive motor and supports, lifts or lowers said one top drive motor in the course of its removal from the rest of the top drive device.

5. The method according to claim 1, wherein the motion arm assembly is a first motion arm assembly among a plurality of motion arm assemblies, wherein the motion arm rail is one of a left-hand vertical motion arm rail and a right-hand vertical motion arm rail present on opposed lateral sides of a vertical path of travel of the trolley with the one top drive device along said at least one vertical trolley rail, wherein each motion arm assembly is mounted on one of the left-hand vertical motion arm rail and the right-hand vertical motion arm rail and is vertically mobile along the respective motion arm rail by a respective motion arm assembly vertical drive, and wherein, if a motion arm assembly among the plurality of motion arm assemblies on a first side is used to remove the one top drive motor, a motion arm assembly among the plurality of motion arm assemblies on a second side is used to stabilize the one top drive device and/or the trolley, the second side being different than the first side.

6. The method according to claim 1, wherein the motion arm assembly is a first motion arm assembly among a plurality of motion arm assemblies, wherein the motion arm rail is one of a left-hand vertical motion arm rail and a right-hand vertical motion arm rail present on opposed lateral sides of a vertical path of travel of the trolley with the one top drive device along said at least one vertical trolley rail, wherein each motion arm assembly is mounted on one of the left-hand vertical motion arm rail and the right-hand vertical motion arm rail and is vertically mobile along the respective motion arm rail by a respective motion arm assembly vertical drive, wherein the one or more top drive motors are provided on respective left-hand and right-hand lateral sides of the top drive device, and wherein a left-hand motion arm assembly among a plurality of motion arm assemblies is used to remove a left-hand side top drive motor among the one or more top drive motors and a right-hand side motion arm assembly among a plurality of motion arm assemblies is used to remove a right-hand side top drive motor among the one or more top drive motors.

7. The method according to claim 1, wherein a spare top drive motor is stored in a compartment within the operative reach of the motion arm assembly, said spare top drive motor being provided with a mechanical coupler part that is to be mated with a corresponding mechanical coupler part on the motion arm to cause the fixation of the spare top drive motor to the motion arm, and wherein the motion arm is used to move the spare top drive motor out of the compartment and then bring it to the top drive device, the spare top drive motor being fitted to the top drive device as a replacement of a faulty top drive motor among the one or more top drive motors.

8. The method according to claim 1, wherein at least one tubulars storage rack stores multi-joint tubulars therein in vertical orientation, and wherein the motion arm assembly is a first motion arm assembly among a plurality of motion arm assemblies, each motion arm assembly comprising a base and an extensible and retractable motion arm, each motion arm assembly being arranged on respective vertical motion arm rail along a side of a vertical path of travel of the trolley with the top drive device along said at least one vertical trolley rail, at least two of said motion arms being provided with a tubular gripper member, with said motion arm rail extending over such a height that a multi-joint tubular stored in the at least one tubulars storage rack can be gripped by the gripper members of the respective motion arm assemblies which act in unison as part of a tubular racker device.

9. A wellbore drilling installation with a top drive device, wherein the installation comprises:

a drilling tower;

a drill floor having a well center for a drilling tubulars string passing through the well center along a firing line;

at least one vertical trolley rail;

a trolley, said trolley being guided along said at least one vertical trolley rail;

a top drive device attached to the trolley, said top drive device comprising one or more top drive motors, the top drive device being adapted to impart rotary motion to a drilling tubulars string when connected to said top drive device;

a hoisting device adapted to move the trolley with the top drive device up and down along said at least one vertical trolley rail;

a vertical motion arm rail;

a motion arm assembly comprising a base and an extensible and retractable motion arm, wherein the base is guided by said at least one vertical motion arm rail, and wherein the motion arm has an operative reach that encompasses the firing line, said motion arm assembly being adapted to support at least one of a well center tool or a tubular gripper member, and allowing to bring said well center tool and/or tubular gripper member in the firing line;

a motion arm assembly vertical drive which is adapted to move the motion arm base along said at least one vertical motion arm rail; and a mechanical coupler part that is fitted on the motion arm, wherein each of the one or more top drive motors is fitted, permanently or only temporarily during servicing, with a mechanical coupler part that is adapted to be mated with the mechanical coupler part that is fitted on the motion arm such that the one or more top drive motors becomes fixed to the motion arm and fully and directly follows any motion of the motion arm.

10. The wellbore drilling installation according to claim 9, wherein the well center tool and/or the tubular gripper member is/are provided with a mechanical coupler part that is similar to a mechanical coupler part of the one or more top drive motors allowing the coupling thereof to the mechanical coupler part that is fitted on the motion arm.

11. The wellbore drilling installation according to claim 9, wherein the vertical motion arm rail is one of a left-hand vertical motion arm rail and a right-hand vertical motion arm rail present on opposed lateral sides of a vertical path of travel of the trolley with the top drive device, wherein the motion arm assembly is a first motion arm assembly among a plurality of motion arm assemblies, and wherein each motion arm assembly is mounted on one of the left-hand vertical motion arm rail and the right-hand vertical motion arm rail and is vertically mobile along the respective rail by a respective motion arm assembly vertical drive.

12. The wellbore drilling installation according to claim 9, wherein the vertical motion arm rail is one of a left-hand vertical motion arm rail and a right-hand vertical motion arm rail present on opposed lateral sides of a vertical path of travel of the trolley with the top drive device along said at least one vertical trolley rail, wherein the motion arm assembly is a first motion arm assembly among a plurality of motion arm assemblies, wherein each motion arm assembly is mounted on one of the left-hand vertical motion arm rail and the right-hand vertical motion arm rail and is vertically mobile along the respective rail by a respective motion arm assembly vertical drive, wherein the top drive device has at least one top drive motor among the one or more top drive motors on the respective left-hand and right-hand lateral sides thereof, and wherein the motion arm assembly mounted on the left-hand vertical motion arm rail is adapted to be used to remove a left-hand side top drive motor and the motion arm assembly mounted on the right-hand vertical motion arm rail is adapted to be used to remove a right-hand side top drive motor.

13. The wellbore drilling installation according to claim 9, wherein the installation comprises a spare top drive motor and a spare top drive motor storage compartment within the operative reach the motion arm assembly, said spare motor being provided with the mechanical coupler part that is to be mated with the mechanical coupler part on the motion arm to cause the fixation of the spare top drive motor to the motion arm.

14. In combination a wellbore drilling trolley and top drive device, which comprises:

a trolley, said trolley being adapted to be guided along at least one vertical trolley rail; and a top drive device attached to the trolley, said top drive device includes:

one or more top drive motors;

a gearbox or transmission housing; and a rotary stem or a quill driven by said one or more top drive motors, wherein said top drive device is adapted to impart rotary motion to a drilling tubulars string when connected to the stem or the quill of the top drive device, wherein the trolley comprises a frame with a top frame member that is adapted to be suspended from one or more winch driven cables of a hoisting device, wherein the frame supports, below said top drive device, a rotatable head clamp assembly that is provided with an open-centered rotary body with a vertical passage there-through that allows lowering of the rotatable head clamp assembly from above onto a top end of a tubular in the firing line, wherein the rotatable head clamp assembly is provided with a tool joint retainer assembly to axially retain a tool joint at the top end of the tubular while the tool joint remains accessible for the rotary stem or the quill of the top drive device, said tool joint having a shoulder and said rotatable head clamp assembly having one or more retainers that are engageable underneath said shoulder, and wherein the rotatable head clamp assembly is provided with a thrust bearing adapted to support the load of a drilling tubular string during a drilling process, when the quill or the rotary stem of top drive device is connected to the tool joint of the top end of the drilling tubular string.

15. The combination of claim 14, wherein the trolley comprises a loop shaped frame with:

said top frame member;

a lower frame member, spaced below the top frame member and a first and second frame members connecting the lower frame member to the top frame member, wherein the top drive device is arranged generally within the opening in the loop shaped frame, and wherein the lower frame member supports said rotatable head clamp assembly.

16. The combination of claim 14, wherein the rotatable head clamp assembly and the thrust bearing is embodied as an exchangeable unit.

17. The combination of claim 14, wherein the top drive device is mounted within the frame so as to be vertically mobile relative to the frame by one or more vertical displacement actuators, and wherein said one or more vertical displacement actuators are adapted to perform a controlled lowering and raising of the top drive device during a make-up or a breaking of the threaded connection between the quill or the rotary stem and to suspend the tool joint of the tubular from the rotatable head clamp assembly.

18. The combination of claim 17, wherein a flexible first drilling fluid hose suspended from an elevated position and hanging in an open loop is connectable at an end thereof to a rigid pipe piece that is fitted on the trolley, and wherein a shorter, flexible second drilling fluid hose is connected between said rigid pipe piece and the vertically mobile top drive device.

19. The combination of claim 14, wherein one or more vertical actuators are provided that allow to vertically displace at least the rotary stem or the quill relative to the rotatable head clamp assembly, and wherein said one or more vertical actuators are adapted to perform a controlled lowering and raising of the rotary stem or quill during a make-up or a breaking of a threaded connection between the quill or the rotary stem and to suspend the tool joint of the tubular from the rotatable head clamp assembly.

20. A method for drilling a wellbore, comprising the step of using the trolley and top drive device combination according to claim 14.

* * * * *